US006390303B1

(12) United States Patent
Clark et al.

(10) Patent No.: US 6,390,303 B1
(45) Date of Patent: May 21, 2002

(54) METHOD FOR OPTIMIZING FLOTATION RECOVERY

(75) Inventors: David William Clark, Gladesville; Billy Kim Fung Chan, Dundas, both of (AU); Rustam H. Sethna, Palatine, IL (US); Peter L. Fleming, Hunters Hill (AU); Jason Simon Tullai, Laverne, CA (US)

(73) Assignee: BOC Gases Austrailia Ltd., Chatswood (AU)

( * ) Notice: Subject to any disclaimer, the term of this patent is extended or adjusted under 35 U.S.C. 154(b) by 0 days.

(21) Appl. No.: 09/359,262

(22) Filed: Jul. 22, 1999

(30) Foreign Application Priority Data

Jul. 24, 1998 (AU) ..... PP4867

(51) Int. Cl.[7] ..... B03D 1/02; B03B 1/04

(52) U.S. Cl. ..... 209/164; 209/1; 209/166; 209/168

(58) Field of Search ..... 209/164, 166, 209/167, 168, 1

(56) References Cited

U.S. PATENT DOCUMENTS 3,094,484 A * 6/1963 Rizo-Patrón
3,883,421 A 5/1975 Cutting et al.
4,559,134 A * 12/1985 Wasson
4,726,896 A * 2/1988 Grove et al.
4,731,176 A * 3/1988 MacDonald
5,011,595 A * 4/1991 Meenan et al.

FOREIGN PATENT DOCUMENTS

SU 668714 * 6/1979
SU 1077634 * 3/1984
SU 1488018 * 6/1989

OTHER PUBLICATIONS

Flotation Agents and Processes, Technology and Applications, Noyes Data Corporation, 1980 ISBN 0–8155–0821–2, pp. 31–32.

Patent Abstract of Japan, JP, 08–224497, A (Sumitomo Metal Mining Co Ltd) Sep. 3, 1996.

Derwent Soviet Inventions Illustrated, Section 1, Chemical, Issued Sep. 9, 1975, vol. W, No. 31 Metallurgical, p. 3 , SU 405247 (Glazunov et al), Dec. 10, 1974.

* cited by examiner

*Primary Examiner*—Thomas M. Lithgow
(74) *Attorney, Agent, or Firm*—Joshua L. Cohen; Salvatore P. Pace

(57) ABSTRACT

A method for optimising a mineral recovery process. A slurry 10 is fed to a conditioning step 20. The condition slurry 30 is then provided to a flotation circuit 40 to recover a concentrate 50. The remainder of the slurry is then rejected as tail 60 or passed for further processing. The present invention provides apparatus for analysing a sample stream 100 of the slurry. A sample stream 100 is provided to an analysis device 200 which treats the sample with an oxidising gas similar to the oxidative treatment 20. Several parameters are measured before and/or after the oxidative treatment of the slurry. The flotability characteristic of the slurry is then determined as a function of the measured parameter(s). The result is used to optimise mineral recovery. This apparatus can be used intermittently or continuously to provide on-going optimisation of the mineral recovery circuit.

26 Claims, 3 Drawing Sheets

METHOD FOR OPTIMIZING FLOTATION RECOVERY

TECHNICAL FIELD

The present invention relates to mineral recovery processes and particularly but not only flotation of valuable minerals which use oxygen as a conditioning and/or flotation gas.

BACKGROUND TO THE INVENTION

The use of flotation processes to recover valuable minerals is well known in the art. The control and optimisation of these processes, however, can sometimes be hit or miss.

A mineral recovery process such as froth flotation which may work extremely well in one geographic location and with one particular type of ore but may be entirely unsuitable in another location due to the different reactivities of the ores.

Further, even at one location and one ore body the reactivity of the ore may change on an hourly, daily or weekly basis. There is significant variability in the characteristics of the ore processed by flotation at any particular mine. Changes are unpredictable and are caused by: ore bodies that are not homogenous, mining practices, stockpiling, crushing, and milling conditions. Even slight changes in the ore's characteristics can upset the delicate balance in the flotation cells and have a substantial negative impact on the recovery of the valuable sulphide mineral.

Researchers have established that most sulphide minerals require some oxygen for complete flotation. There are three collector reaction mechanisms generally accepted for xanthate type collectors (the most common collector type used) that lead to making valuable minerals floatable:

Electrostatic Collector Attraction $$MeS+H_2O+2O_2=Me(H_2O)^{2+}+SO_4^{2-}$$

The ionically charged collector attracts to the mineral surface

Chemisorption

1) $MeS+2O_2=MeSO_4$

2) $MeSO_4+CO_3^{2}--=MeCO_3+SO_4^{2-}$

3) $MeCO_3+2X=MeX_2+CO_3^{2-}$

Metal xanthate layer builds up on mineral surface.

Electrochemical Oxidation

1) $2X^{-}+1/2\ O_2+H_2O=X_2+20H^{-}$

2) $MeS+X_2=(MeS)^{X}{}_{2ads}$

The collector is initially oxidised and then attaches to the mineral surface.

Oxygen is required for each of the collector mechanisms recognised. Oxygen is the principal electron acceptor. Oxidising conditions favour reaction with xanthate type collectors including dithiophosphates. Thiocarbamate and thiourea collector actions also require oxygen for complete flotation.

Many flotation pulps are oxygen deficient. Milling produces a reducing environment. Grinding media and minerals corrode. Oxygen in the pulp is consumed. Some minerals present in the ore can be significant oxygen consumers eg pyrrhotite, marcasite, pyrite.

Valuable sulphide minerals are also prone to over oxidation that can reduce flotability. Previously, where an oxygen deficiency has been recognised air was used as the oxidation gas. Due to its low dissolved oxygen saturation point (5–8 ppm), the danger of over oxidation was minimal. However, the applicant has discovered that the intensity of oxidative conditioning in the full scale application can usually only be achieved by using an oxygen-rich gas which has a higher saturation point. This in turn may lead to over oxidation over the valuable mineral, if the addition of the oxidation gas is not adequately controlled.

In the flotation of sulphide ores it has been found that the oxidising environment in the pulp, as measured by oxidation—redox potential (or Eh) has a strong influence on the flotation result. Eh has frequently been measured but not often used as a control parameter. The reasons for this include unreliable electrodes, changes in Eh being more attributable to changes in pH, and the difficulty in controlling Eh by some reagent addition.

Dissolved oxygen (DO) concentration in the pulp has also been tried as an indicator of the status of the flotation process. Air has been occasionally used as an aeration gas to raise the dissolved oxygen concentration of the slurry. Measurement of dissolved oxygen concentration though does not give sufficient information on whether ore oxygen gas flow requirements have been optimised.

The applicant has found that the oxidative conditioning step in the ACTIFLOAT process, which is subject of Australian patent no 670,163 and application no 37917/95 and several overseas patents and co-pending applications, provides substantial improvements over conventional flotation methods. There is no doubt that with many ores an oxidative conditioning step conducted prior to or simultaneously with the flotation step increases the recovery of the valuable mineral over conventional treatment.

Current and potential users of the process, however, have indicated that it would be useful to have in place methods and equipment to rapidly and accurately determine the oxygen gas flow requirements of the slurry being processed, fluctuations in the make up of the ore will change the oxygen gas flow requirements. Optimising oxygen addition is an important component of the overall efficiency of the ACTIFLOAT process.

Equally, some ores may not be susceptible to oxidative conditioning or alternatively such conditioning may in fact be detrimental to mineral recovery. In such instances it would be beneficial to determine whether the oxygen gas flow requirements of such ores are negligible and thereby characterise the flotability of the slurry.

The present invention seeks to provide a method for controlling a mineral recovery process which overcomes at least some of the disadvantages of the prior art or provides a commercial alternative thereto.

STATEMENT OF INVENTION

In a broad aspect, the present invention provides a method of optimising a mineral flotation recovery process comprising extracting a representative sample of a slurry containing the mineral to be recovered, treating the sample with an oxidising gas, measuring one or more parameters before and/or after said oxidative treatment wherein the change in said parameter(s) is indicative of the flotability of the minerals contained in the slurry, characterising the slurry as a function of said measured parameter(s), and controlling the mineral recovery process in accordance with said slurry characteristic.

The present applicant has found that the inventive method is particularly suitable for optimising the ACTIFLOAT process ie a process which has oxidative conditioning of the slurry. It will be recognised, however, that the inventive method is also suitable for other flotation processes such as MAXIFLOAT and CLEANFLOAT both of which use non-oxidising gases to condition or float the desired minerals.

The present invention provides a mechanism for optimising a mineral flotation recovery process in several ways, namely:

a) characterising a slurry by providing a measure of the flotability of the minerals contained therein after an oxidative gas treatment, b) determining the effect of various control regimes on the slurry and indeed the entire mineral recovery process eg what effect do different dissolved oxygen, pH, electrochemical potential levels, different mixing times, different intensities of mixing etc have on the flotation recovery of the valuable minerals, and c) providing an historic record of the correlation between the effect of different parameter alterations, ore types etc and the flotability of the minerals contained within the slurry thereby allowing an operator to predict what control parameters are required to optimise mineral recovery.

In another broad aspect, the present invention provides an apparatus for optimising a mineral flotation recovery process comprising means for extracting a representative sample of the slurry, means for treating the sample with the oxidising gas, means for measuring one or more parameters before and/or after said oxidative treatment wherein the change in said parameter(s) is indicative of the flotability of minerals contained in the slurry, and means to determine a slurry flotability characteristic as a function of said measured parameter(s), said apparatus being operatively linked with said mineral flotation recovery process to thereby control said mineral flotation recovery process in accordance with said slurry characteristic.

The parameters to be measured may be selected from any one of dissolved oxygen concentration, electrochemical potential, pH, temperature, chemical species in solution, mineral content, mineral surface composition and mineral surface properties. It will be appreciated by persons skilled in the art that the change in these parameters is indicative of the flotability of the minerals contained within the slurry.

In accordance with the invention, as many parameters of the slurry as are required are measured to provide a reliable characterisation of the flotability of the contained minerals in the slurry. By the phrase "indicative of the flotability of minerals contained in the slurry" we mean indicative of the flotability of minerals in the slurry per se, but also indicative of the flotability of the minerals in slurry when subjected to the respective mineral recovery process. A mineral slurry may be perfectly flotable in one process yet difficult to float in another process where the changes in process parameters are quite minor.

The list of parameters mentioned above is not meant to be exhaustive. One of the advantages of the present application is that the type and number of parameters to be measured may be tailored by an individual operator to suit the particular mineral recovery process. For instance, if consistent water supply is not reliable and water must be obtained from different sources, it may also provide helpful to measure various parameters of the slurry water to determine its effect on the flotability of the slurry.

Another advantage of the present invention is its ability to apply a series of experiments to the representative sample under conditions which do not replicate the mineral recovery process but which serve to optimise the mineral recovery process. To explain, in an embodiment where the mineral recovery process includes an oxidative conditioning step, it may be determined that the oxidative gas treatment applied to the representative sample should replicate the oxidative conditioning step in the mineral recovery process. Alternatively, a series of experiments may be applied to the representative sample under conditions which do not replicate the oxidative conditioning step. These experiments may include different oxidising gas types, different mixing times, different intensities of mixing and different temperatures.

In some mineral flotation recovery processes, little or no oxidative conditioning is required or applied. The inventive method and apparatus, however, is still useful in characterising the slurry. The tests applied to the representative sample may be used to confirm whether or not the mineral recovery process may be optimised by including an oxidative conditioning step.

In this way, an operator can experiment with the current slurry passing through the mineral recovery process without interrupting or upsetting the mineral recovery process itself. It will be appreciated, that this is a very useful mechanism for applying alternative process parameters to optimise the mineral recovery process.

The method and apparatus has been discussed above as being used to optimise a mineral recovery process. It will be appreciated, however, that the method and apparatus may equally be used simply to characterise a slurry by determining the flotability of its contained minerals. The characterisation of the slurry can be used for a number of purposes other than optimisation of the mineral recovery process. For example, it is useful to determine which ore is more easily flotable or more compatible with current process equipment and limitations attached thereto. An example may be where it is intended to change the ore body from which the slurry originates. Clearly there would be significant advantages in being able to test several alternative ore bodies to determine their compatibility with current process equipment.

In a third aspect, the present invention provides a method of characterising the flotability of a slurry in a mineral flotation recovery process comprising extracting a representative sample of the slurry to be floated, treating the sample with an oxidising gas, measuring one or more parameters before and/or after said oxidative treatment wherein the change in said parameter(s) is indicative of a flotability of the minerals contained in the slurry, and characterising the slurry as a function of said measured parameter(s).

In a fourth aspect, the present invention provides an apparatus for characterising the flotability of a slurry in a mineral recovery process comprising a slurry feed to extract and provide a representative sample of the slurry to be floated, an oxidising gas supply to contact and treat the sample with an oxidising gas, an analysis means to measure one or more parameters both before and/or after said oxidative treatment wherein the change in said parameter(s) is indicative of the flotability of the minerals contained in the slurry, and a calculation means to determine the flotability characteristic of the slurry as a function of said measured parameter(s).

Unless the context clearly requires otherwise, throughout the description and the claims, the words 'comprise', 'comprising', and the like are to be construed in an inclusive as opposed to an exclusive or exhaustive sense; that is to say, in the sense of "including, but not limited to".

BRIEF DESCRIPTION OF THE DRAWINGS

The present invention will now be described by way of example only with reference to the accompanying drawings in which.

BEST MODE(S) FOR CARRYING OUT THE INVENTION

The present invention will now be described with reference to FIG. 1 and with particular reference to the ACTIFLOAT mineral recovery process. It should be understood, however, that the present invention is suitable for other mineral recovery processes.

Figure 1:
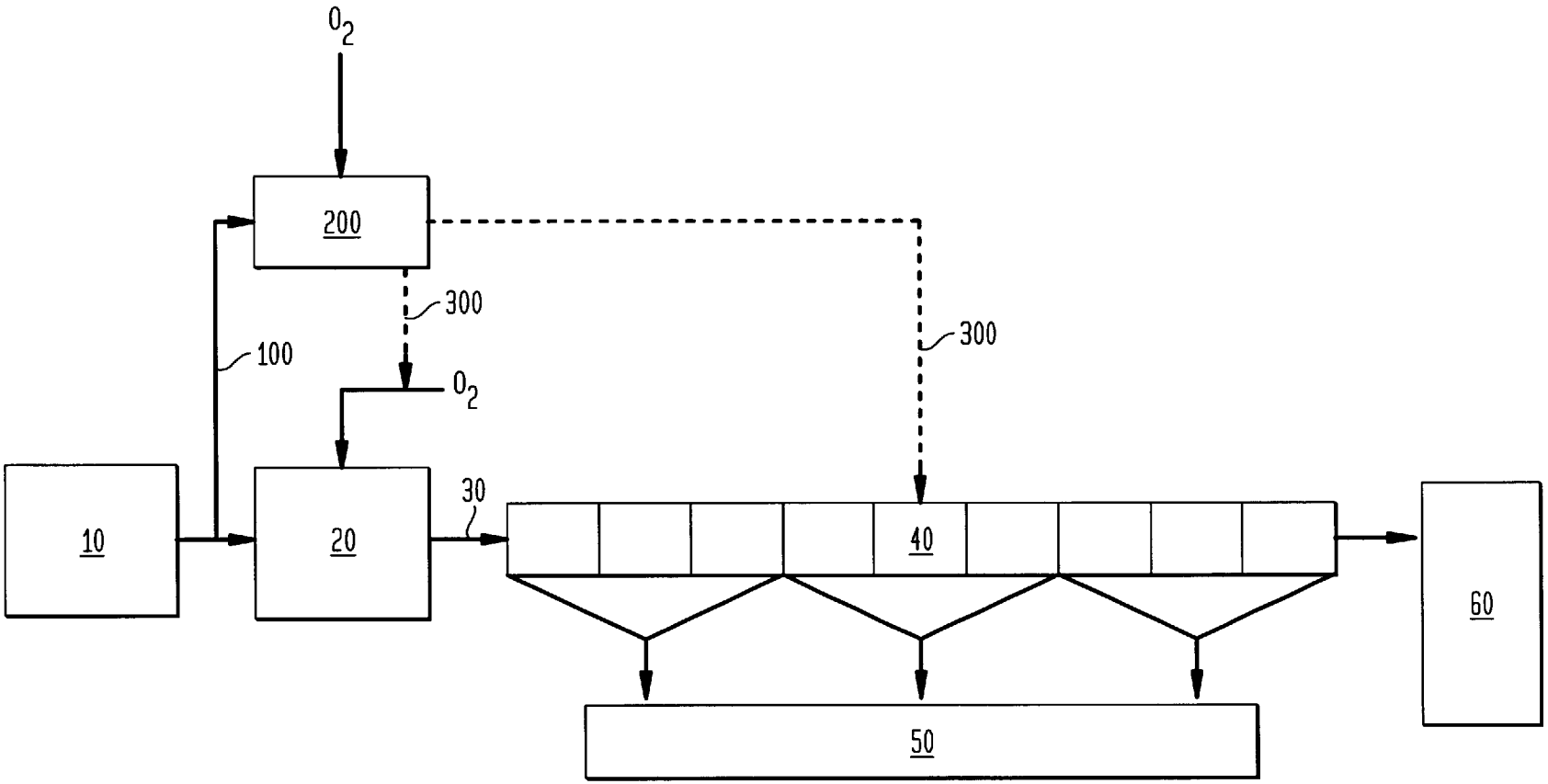
FIG. 1 is a flow diagram of a mineral recovery process employing an optimisation method in accordance with a first embodiment of the present invention.

Referring to FIG. 1, in the ACTIFLOAT process a slurry or pulp is prepared by milling the ore in a liquid eg water until it reaches the desired particle size. This feed slurry 10 is then passed to a conditioning step 20 where the slurry is mixed with an oxidising gas eg oxygen or ozone and optionally other reagents, collectors, frothers etc. The conditioned slurry 30 is then fed to the flotation circuit 40 and the valuable minerals recovered as a concentrate 50. The remainder of the slurry is rejected as tails 60.

As will be clear to persons skilled in the art, the oxidative conditioning step 20 acts to "prime" the slurry before the flotation circuit. In the flotation of sulphide ores, it has been found that the oxidising environment in the slurry, as measured by redox potential and/or dissolved oxygen concentration, has a strong influence on the flotation result. The presence of the oxidising gas is suspected to activate the surface of the sulphide mineral in the slurry to thereby make it more susceptible to bonding with a collector. It is important, however, that the duration of the oxidative conditioning is controlled to provide sufficient oxidation while still avoiding over-oxidation which may create difficulties in terms of less efficient collector usage in at least two ways, namely that the collector itself may be destroyed or the mineral surface may be rendered less susceptible to bonding with the collector than would ordinarily be the case.

Accordingly, the present invention seeks to optimise the mineral recovery process by characterising the slurry and in accordance with the results of such analysis controlling the flotation process in particular the conditioning step to optimise the flotability of the minerals contained in the slurry.

In the embodiment shown, a sample stream 100 is directed toward analysis equipment 200. In this analysis equipment 200, the sample slurry undergoes an oxidative treatment whereby it is mixed with an oxidising gas. One or more parameters eg DO levels, pH, Eh, temperature are measured before and after mixing with oxygen and the change in this parameter determined. From the change in these values an indication of the flotability of the contained minerals is provided and the slurry may then be characterised as a function of these measured parameters. Once this has been determined the control unit, via control lines 300, can optimise the process conditions for the mineral recovery process as a whole and particularly the oxidative conditioning step 20. The analysis equipment 200 may be linked to any of the control elements in the mineral recovery process or in the oxidative conditioning step 20, such as the oxygen modulating valve and/or slurry feed pump, via a single control loop or a plc. This feed forward control will reduce large lag errors between the measurement of the controlled variable and the effect of the control action.

Conventional bench scale testing may establish that for a particular ore, a dissolved oxygen level of between 10 and 40 ppm and a conditioning time of 1 to 8 minutes is required for maximum recovery of the valuable mineral. In the full scale plant, however, the ore and slurry characteristics are continually changing for reasons previously mentioned and therefore the optimum settings for mineral recovery are also changing.

With the inventive method a technique is provided whereby the analysis equipment 200 can continuously or intermittently determine the optimum mineral recovery process including requirements for oxygen gas flow and other additives eg collectors, frothers, non-oxidising gases and then put into effect the most appropriate process control including oxidative conditioning regime to meet this target and thereby obtain maximum recovery of the valuable mineral prior to the slurry entering the flotation circuit. This optimisation of the recovery process can of course be accomplished in many ways eg control of oxygen flow, different intensities or times of mixing, using different oxidising or flotation gases, dosage with other components eg ozone instead of oxygen.

These various alterations may also be tested on the sample slurry by the analysis equipment 200 after it has determined for example the oxygen gas flow requirements to ascertain which is the most efficient for meeting these oxygen gas flow requirements prior to entry into the flotation circuit. The analysis equipment may not only measure the effect of different DO levels on the mineral recovery process but also the differences in intensity of mixing, different mixing times, different oxidising gases and different concentrations of oxidising gases on the oxidative treatment of the slurry and accordingly the mineral recovery process overall.

Each of the parameters may be measured separately or in conjunction with each other to determine what combination of control features optimises the oxidative conditioning step in the mineral recovery process and recovery of the valuable mineral.

It is also possible to include the various equipment constraints in any experiments conducted by the analysis equipment 200. Generally, there will be various constraints on the variability of the oxidative conditioning step 20 in the mineral recovery process. It may only be possible to increase power by say 10% or, for example, increase the quantity of oxidising gas to the conditioning step by 10–15%. The analysis equipment can include these equipment constraints so that it conducts its own oxidative treatment step on the sample slurry within these equipment constraints thereby optimising the mineral recovery process within the constraints of the process overall.

It is also possible to take samples of the slurry at different points in the mineral recovery process. For example, an operator may determine that the samples should be taken upstream of the conditioning step, during the conditioning step and/or downstream of the conditioning step and correlate these samples with the mineral recovery process itself.

Still further, the analysis equipment may include a recordal function for storing the results of its own oxidative treatment on the sample slurry but also the effect of altering various process parameters in the mineral recovery process and how its own sample test data correlate to the historical data of the mineral recovery process.

Figure 2:
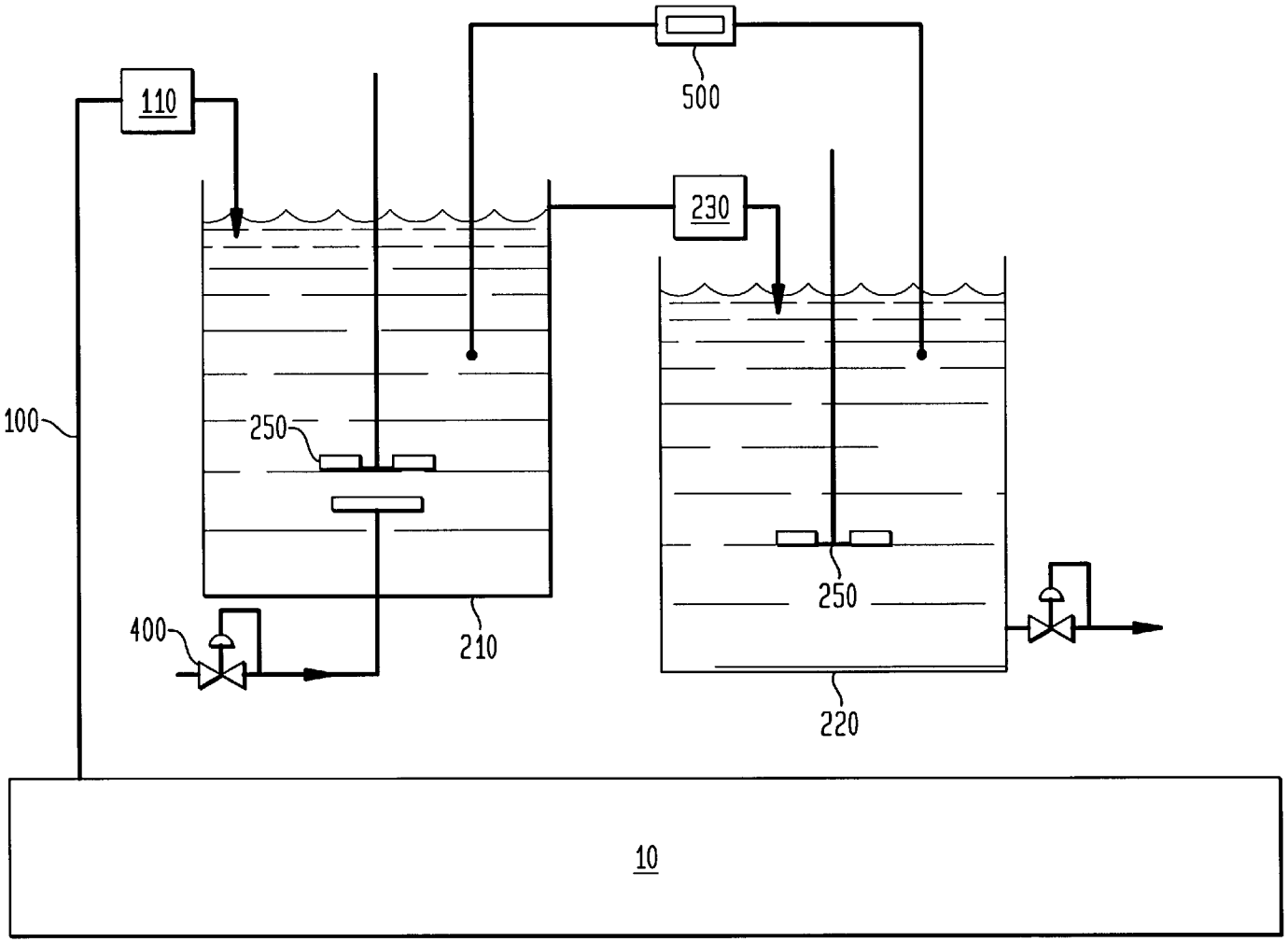
FIG. 2 is a diagram of an optimisation apparatus in accordance with a second embodiment of the present invention.

FIG. 2 provides a simplified diagram of analysis equipment 200. In this example, feed slurry 10 enters analysis equipment 200 via sample stream 100. A metering pump 110 measures the quantity of slurry entering the equipment. In this example, the equipment comprises two tanks 210, 220 with a metering pump 230 therebetween. Metering pump 110 provides a continuous or intermittent stream of slurry to first tank 210. Oxygen 400 is supplied to the first tank to provide a dissolved oxygen concentration of between 12 and 20 ppm. The outlet port of the first tank carries slurry via metering pump 230 to the second tank 220. Both tanks are agitated via mixers 250 to ensure uniform oxygen concentration throughout the slurry. The dissolved oxygen concentrations are measured via DO meter 500. Volumetric flow rates are measured via the metering pumps. Preferably the dissolved oxygen concentration is measured at both the inlet and exit port of the second tank 220.

This analysis equipment can either intermittently or continuously provide a reading of the oxygen gas requirements of the slurry as follows. The time course of dissolved oxygen concentration within second tank 220 is dependent upon the ore/oxygen reactiveness ie the rate of oxygen uptake by the slurry, and the dwell time of the slurry within tank 220. Expressed formally, the differential equation for the oxygen concentration "C" within second tank 220 is $$V \cdot \frac{dC}{dt} = Q \cdot (Cin - Cout) - k.C \tag{1}$$

In equation (1) V represents the tank volume, Q is the slurry flow rate and k is the slurry oxygen consumption characteristic. A solution to this equation leads to the following expression for the rate constant β of oxygen consumption within the slurry $$\frac{k}{V} = \beta = \frac{(Cin - Cout)}{T.Cout} \tag{2}$$

In equation (2), T is the residence time for the slurry within second tank 220, which is given by V/Q. The dissolved oxygen levels $C_{in}$ and $C_{out}$ are obtained by using the oxygen probes shown respectively at the input and exit of the second tank, as described earlier.

The rate constant β for oxygen consumption of slurry is obtained by using steady state measurements of the parameters Q, $C_{in}$ and $C_{out}$. This method allows precise measurements of β. An error analysis of equation (2) yields a fractional error in B $$\frac{\Delta\beta}{\beta} = \frac{\Delta T}{T} + \frac{1}{\left(1 - \frac{Cout}{Cin}\right)}\left\{\frac{\Delta Cin}{Cin} - \frac{\Delta Cout}{Cout}\right\} \tag{3}$$

A principal error source arises from the measurement of the dissolved oxygen at the input and exit of the second tank 220. Further error is introduced in the measurement of the slurry volumetric flow rate. Using equation (3) and the known precision of measurement for dissolved oxygen and slurry flow, the overall precision in the evaluation of β by this method can be shown. The measurement precision for β is found to be a strong function of the slurry residence time. The greatest error occurs at high values of β. A measurement precision of less than 5% can, however, be achieved if the residence time is constrained to be less than two minutes.

At low values of β, a short residence time may cause the arithmetic difference between $C_{in}$ and $C_{out}$ to approach the sum of the measurement precision of the dissolved oxygen probes. Under these conditions, a longer residence time can be selected.

β is a value representative of the oxygen gas requirements of the ore. It is to a certain extent artificial. You cannot directly measure β. Rather, it is a function of other measured parameters which, while each one is important, none of which alone give a complete picture of the flotability of the ore.

Further, measurement of such standard parameters only gives a snapshot of a slurry. It does not take into account the large number of other variables which influence the flotability of the slurry ie water quality, fluctuation in ore flow rates, temperature changes, changes in quality of other additives such as collectors, frothers etc.

Accordingly, it is desirable that the analysis equipment include a recordal function such that values of β can be compared with historical data which correlate β with mineral recovery. A typical example is shown in FIG. 3.

Figure 3:
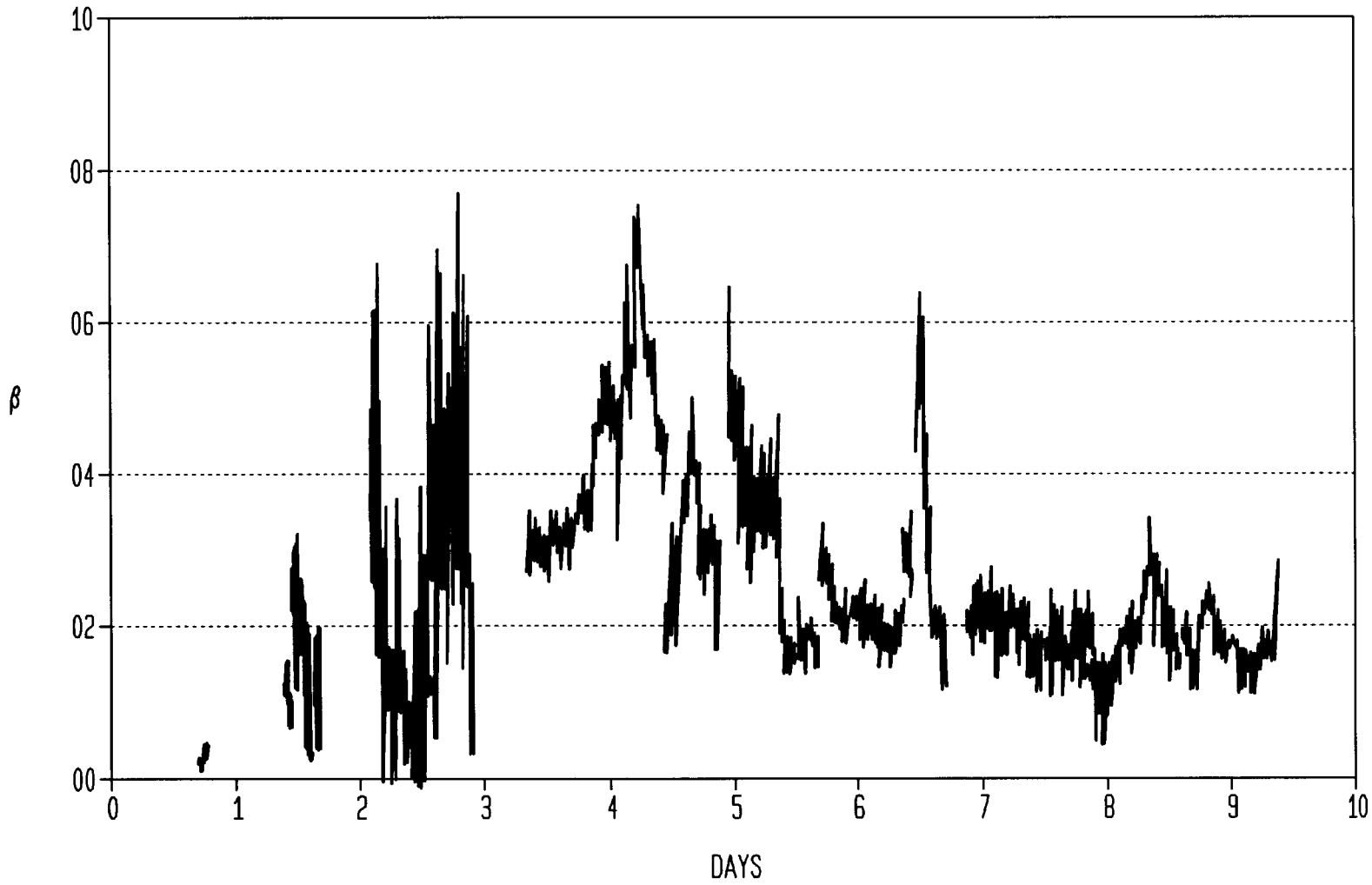
FIG. 3 is a graph of the output of the analysis equipment of FIG. 2.

To attain FIG. 3, the analysis equipment was used intermittently and continuously over a period of approximately 10 days. As can be seen from FIG. 3, the values of β fluctuated wildly from just above 0 to 0.8. As can be seen from FIG. 3, it took some time for the analysis equipment to reach steady state and from approximately day 6 onward consistent values of β were obtained. These values of β characterize the slurry undergoing mineral recovery and can be used to control both the oxidative conditioning step and mineral recovery process to obtain maximum mineral recovery.

β in this instance is a characteristic of the slurry. Of course, by altering the design and operation of the analysis equipment eg such that it replicates the oxidative conditioning step, one may also determine the effect of different oxidative conditioning steps on the slurry and thereby determine the most appropriate oxidative conditioning parameters for a particular ore. In this way β becomes characteristic of the slurry and the mineral recovery process.

Accordingly, it can be seen that the present invention provides a self-tuning control mechanism for optimising the mineral recovery process. It takes into consideration different ore reactivities and quickly adapts the oxidative conditioning step to optimise the slurry entering the flotation circuit and thereby increasing the recovery of the valuable minerals from the flotation process.

It will be appreciated by those skilled in the art that the method described can be embodied in other forms without departing from the spirit or scope of the present invention.

What is claimed is:

1. A method of optimising a mineral flotation recovery process comprising the steps of: extracting from a slurry a representative sample containing a mineral to be recovered, treating the representative sample with an oxidising gas, measuring one or more parameters of the representative sample before and/or after said oxidative treatment, determining change in said parameter(s) indicative of the flotability of the minerals contained in the slurry, characterising the slurry as a function of said parameter(s) being measured, and controlling the mineral recovery process in accordance with characterization of said slurry.

2. A method as claimed in claim 1 wherein the slurry containing the mineral to be recovered undergoes an oxidative conditioning step prior to or simultaneously with flotation recovery of the mineral, said method characterising the slurry by determining the oxygen gas flow requirement of the slurry as a function of said measured parameter(s) and controlling the oxidative conditioning step in accordance with the oxygen gas flow requirement of the slurry to optimise mineral recovery.

3. A method as claimed in claim 2 wherein the oxidising gas used in the oxidative treatment and oxidative conditioning step is selected from the group consisting of oxygen, ozone and mixtures thereof.

4. A method as claimed in claim 1 wherein the mineral flotation recovery process is controlled by optimising the addition of additives used in the mineral flotation recovery process other than oxidising gas.

5. A method as claimed in claim 1 wherein the parameter (s) of the slurry to be measured is selected from one or more of the group consisting of dissolved oxygen concentration, electrochemical potential, pH, temperature, chemical species in solution, mineral content, mineral surface composition and mineral surface properties.

6. A method as claimed in claim 1 wherein the oxidative treatment exposes the representative sample to different oxidising gas types, mixing times and intensities of mixing.

7. A method as claimed in claim 1 wherein said parameter (s) are first measured before and/or immediately after contact with the oxidising gas, and said parameter(s) are measured again a predetermined time after initial contact with the oxidising gas.

8. A method as claimed in claim 1 wherein the correlation between said parameter(s) and the characteristic of the slurry are recorded over a time period to provide a historical record of the effect of different parameter alterations to the flotability of the minerals contained in the slurry.

9. A method as claimed in claim 8 wherein said historical record is used to predict the effect of said parameter(s) on the efficiency of flotation of the slurry.

10. A method as claimed in claim 1 wherein any one of the steps of extraction of the sample, treating the sample, measuring said parameter(s) or characterising the slurry is conducted intermittently during the mineral recovery process.

11. A method as claimed in claim 1 wherein any one of the steps of extraction of the sample, treating the sample, measuring said parameter(s) or characterising the slurry is conducted continuously during the mineral recovery process.

12. A method as claimed in claim 2 wherein the oxidative treatment of the sample replicates the oxidative conditioning step in the mineral recovery process.

13. An apparatus for optimising a mineral flotation recovery process comprising: means for extracting a representative sample of the slurry, means for treating the representative sample with oxidising gas, means for measuring one or more parameter(s) of the representative sample before and/or after said oxidative treatment, wherein the change is said parameter(s) is indicative of flotability of minerals contained in the slurry, means to determine a slurry flotability characteristic as a function of said measured parameter(s), and first control means for said mineral flotation recovery process, and first control means being operatively linked with said mineral flotation recovery process to control said recovery process in accordance with said slurry characteristic.

14. An apparatus as claimed in claim 13 wherein the slurry containing the mineral to be recovered undergoes an oxidative conditioning step prior to simultaneously with flotation of the mineral, said apparatus further including: gas flow means to determine oxygen gas flow requirement of the slurry as a function of said measured parameter(s) and second control means to control the oxidative conditioning step in accordance with the oxygen gas flow requirement of the slurry to optimise mineral recovery.

15. An apparatus as claimed in claim 14 further including; third control means to control supply of oxygen, ozone or a mixture thereof for the oxidative treatment and the oxidative conditioning step.

16. An apparatus as claimed in claim 13 further comprising means to optimise addition of additives other than oxidising gas to control said mineral flotation process.

17. An apparatus as claimed in claim 13 wherein said means for measuring one or more parameters is adapted to measure one or more of the group consisting of dissolved oxygen concentration, electrochemical potential, pH, temperature, chemical species in solution, mineral content, mineral surface composition and mineral surface property.

18. An apparatus as claimed in claim 13 further comprising: means for exposing the representative sample to different oxidising gas types, mixing times or intensities of mixing.

19. An apparatus as claimed in claim 13 wherein said apparatus is adapted to conduct a first measurement of said parameters before and/or immediately after contact with the oxidising gas and a second measurement of said parameters at a predetermined time after initial contact with the oxidising gas.

20. An apparatus as claimed in claim 13 further comprising recordal means to measure and record the correlation between said parameter(s) and the characteristic of the slurry and thereby provide a historical record of the effect of different parameter alterations to the flotability of the minerals contained in the slurry.

21. An apparatus as claimed in claim 20 further comprising a predictive means adapted to predict the effect of altering said measured parameter(s) on the efficiency of flotation of the slurry.

22. An apparatus as claimed in claim 13 wherein extraction of the sample, treating of the sample, measurement of parameters or characterisation of the slurry is conducted intermittently during the mineral recovery process.

23. An apparatus as claimed in claim 13 wherein extraction of the sample, treating of the sample, measurement of parameters or characterisation of the slurry is conducted continuously during the mineral recovery process.

24. An apparatus as claimed in claim 14 wherein the treatment of the sample with an oxidising gas replicates the oxidative conditioning step in the mineral recovery process.

25. A method of characterising the flotability of a slurry in a mineral flotation recovery process comprising the steps of: extracting a representative sample of the slurry to be floated, treating the representative sample with an oxidising gas, measuring one or more parameters of the representative sample before and/or after said oxidative treatment, determining change in said parameter(s) indicative of a flotability of the minerals contained in the slurry, and characterising the slurry as a function of said parameter(s) being measured.

26. An apparatus for characterising the flotability of a slurry in a mineral recovery process comprising: a slurry feed to extract and provide a representative sample of the slurry to be floated, an oxidising gas supply to contact and treat the representative sample with an oxidising gas, analysis means to measure one or more parameters of the representative sample before and/or after said oxidising treatment, wherein the change in said parameter(s) is indicative of the flotability of the minerals contained in the slurry, and calculation means to determine the flotability characteristic of the slurry as a function of said measured parameter (s).

* * * * *